US005921188A

United States Patent [19]

Kohlhaas

[11] Patent Number: 5,921,188

[45] Date of Patent: Jul. 13, 1999

[54] NESTABLE SINGLE DECK PALLET

[76] Inventor: Frank A. Kohlhaas, 130 Lake Julia Dr. North, Ponte Vedra Beach, Fla. 32082

[21] Appl. No.: 09/106,516

[22] Filed: Jun. 29, 1998

Related U.S. Application Data

[51] Int. Cl.[6] ..... B65D 19/38

[52] U.S. Cl. ..... 108/52.1; 108/53.3

[58] Field of Search ..... 108/52.1, 53.1, 108/53.3, 55.5, 51.11; 206/386, 596, 598

[56] References Cited

U.S. PATENT DOCUMENTS

| | | | |
|---|---|---|---|
| 2,584,762 | 1/1952 | Vossenberg | 108/52.1 |
| 3,294,040 | 12/1966 | Gregoire | 108/53.3 |
| 3,630,157 | 12/1971 | Ortenblad | 108/53.3 |
| 3,675,595 | 7/1972 | Sullivan | 108/55.5 |
| 5,329,862 | 7/1994 | Breezer et al. | 108/52.1 |

*Primary Examiner*—Peter M. Cuomo
*Assistant Examiner*—Gerald A. Anderson
*Attorney, Agent, or Firm*—Thomas C. Saitta

[57] ABSTRACT

A nestable, single deck member pallet having a pair of notches on one edge, the notches sized greater than the width of forklift tines and passing completely through the deck member in the vertical direction, and preferably having a pair of notches each on two opposing edges of the deck member, where the notches are asymmetrically positioned on the edges such that the notch pairs of multiple pallets, when properly oriented, are not vertically aligned, allowing the tines of a forklift to be inserted to lift a single pallet from a stack of pallets.

14 Claims, 2 Drawing Sheets

NESTABLE SINGLE DECK PALLET

BACKGROUND OF THE INVENTION

This invention relates generally to the field of pallets, relatively planar support members used as a platform to allow movement of heavy and/or multiple items by a fork lift or hand truck having tines or forks insertable into or under the pallet, and in particular relates to pallets which have single deck members supported by a plural number of depending leg members. Even more particularly, the invention relates to such pallets which are nestable in a manner which minimizes the vertical height of a stack of unloaded pallets.

Pallets are well known devices commonly used in the transportation and storage of goods. A pallet has a substantially horizontal support surface, called a deck member, onto which items are placed which cannot easily be moved, either because of the size, weight and configuration of the objects themselves, or because a method is desired for easy movement of large numbers of smaller items, such as for example a number of small boxes or cartons. The pallet is configured to allow insertion of the tines or forks of a hand truck or fork lift beneath the deck member between the legs. To move the pallet the tines are inserted beneath the deck member and the tines and the pallet are raised off the floor, the fork lift or hand truck having power means sufficient to raise the loaded weight of the pallet, typically accomplished by hydraulic mechanisms. The fork lift or hand truck being wheeled, the loaded pallet can then be moved to the desired location, such as onto or from a transport trailer or to a different location within a warehouse. The pallet is then lowered to the ground and the tines are withdrawn. Common pallets are constructed with an upper deck member and a lower deck member separated by brace members, and the tines are inserted into the vertical gap between the two deck members and laterally between the brace members. Because the deck members must be separated a distance of several inches to provide the gap for the tines, and because the lower deck member of a superior pallet rests directly on the upper deck member of an inferior pallet when stacked vertically, storage and transport costs for unloaded pallets are increased, since the pallets are not vertically nestable.

To reduce the vertical height of unloaded pallets when stacked, i.e., to increase the number of unloaded pallets which can be stacked in a given vertical space, nestable pallets having single rather than double deck members have been developed. The single deck member is the planar support member for the goods and is supported by a plural number of leg members which are positioned to allow insertion of the fork lift tines beneath the deck member between adjacent legs. The leg members have open interiors and tops, and are mounted onto the deck member such that the open interior is exposed from or accessible through the upper side of the deck member. The outer configuration of the legs taper downward, such that the legs of a pallet placed directly on top of another similar pallet will enter the open interiors of the legs in the lower pallet, rather than sit atop the deck member of the lower pallet, thus reducing the vertical distance between the deck members. This allows a much larger number of unloaded pallets to be stacked in a given space.

To achieve the maximum density of nested pallets, the pallets would ideally be designed such that the lower surface of the deck member of a superior pallet contacts the upper surface of the deck member of the immediately inferior pallet. In other the words, the legs members are designed such that they are fully insertable into the interior spaces of the legs in the lower pallet such that no gap exists between the deck members of adjacent pallets. While this construction maximizes nestability of the pallets, it presents a problem in that it is difficult to separate the tightly nested individual pallets for use, usually requiring the pallets to be separated manually. This reduces work efficiency, as ideally the pallets should be separable by the fork lift operator using only the tines of the fork lift.

An early design which addresses this problem is shown in U.S. Pat. No. 3,641,949 to Monk. Monk discloses a nestable single deck member pallet which can be more densely stacked with the pallets oriented in one direction, but which provides a less dense stack if alternating pallets are oriented in a different direction, thus providing a larger separation between adjacent deck members so that the tines can be easily inserted therebetween. This construction, however, still requires that the pallets be manually separated when nested in the dense orientation, and does not provide a nested stack of maximum density which is still accessible to the fork lift tines. A different approach is taken in U.S. Pat. No. 4,879,956 to Shuert, wherein the pallet is constructed to allow access for the fork lift tines when the pallets are nested in a manner to provide maximum density. As shown in FIG. 10 of that patent, the pallets are provided with short upper and lower ramp surfaces which in combination with the ramp surfaces of an adjacent stacked pallet define a notch to receive the tips of the fork lift tines. This design requires the deck member to be relatively thick if formed of wood, since the ramps must be cut into both the upper and lower surface of the deck member, or requires it be formed of plastic in the generally complicated manner disclosed in that patent. This precludes usage of this construction in composite pallets formed of two planar sheet members joined by lightweight filler material, such as corrugated cardboard positioned between two thin plywood sheets. Another drawback to this design is that the notches are vertically aligned in columns when pallets are stacked, meaning that there is very minimal separation between the notches of adjacent pallets. With the added problem that there is little visual demarcation between adjacent notches, the likelihood of a fork lift operator being able to quickly and easily separate a single pallet from a stack using the tines of the fork lift is very low, and will typically require several attempts to set the tips of the tines at the exact proper height to meet the desired notches.

It is an object of this invention to provide a construction for nestable single deck pallets which allows vertical stacking in a manner of maximum density, where individual pallets can be removed from the nested stack using only the tines of a fork lift, without the need to manually separate or remove the individual pallet. It is a further object to provide such pallets where the separation is accomplished by providing a pair of cut-outs or notches on one or more sides of the deck member, the notches located asymmetrically on each side relative to the midpoint of the side, thereby allowing the pallets to be stacked such that the notches of adjacent pallets are not vertically aligned in a single column in order to increase the visual demarcation between adjacent notches. It is a further object to provide such notches in pallets having deck members constructed of composite materials, whereby the deck member is formed with two thin, planar sheet members connected by relatively lightweight internal material, such as corrugated cardboard.

SUMMARY OF THE INVENTION

The invention comprises in general an improvement in a pallet having a generally planar, horizontally extending single deck member, the deck member supported above flat surfaces by depending plural leg members, where the leg members have open or hollow interiors and are open on top when the legs are connected to the deck, such that the deck is apertured where the legs are attached to the underside or the interior of the deck, or where the legs themselves extend completely through the deck. The leg members are tapered so as to be diminishing in horizontal cross-section from top to bottom, which allows the legs on a superior pallet to be inserted into the interior of the legs on an inferior pallet, such that the adjacent pallets are nested in a manner which allows the deck members to contact, such that the pallets are nested with maximum density. The improvement is the provision of pairs of notches which are cut into the sides of the deck member, the notches being wider than the typical width of the tines of a fork lift and extending a short distance into the body of the deck member, but extending completely through the deck member vertically, where the notches are asymmetrically located on the side of the pallet, such that each notch of a given pair of notches is a different distance from the center of the side. In this manner, when a pair of adjacent pallets in a nested stack are properly oriented, the notch pairs will not be vertically aligned. This non-vertical alignment results in a portion of the lower surface of the upper deck member extending above the notches on the lower deck member. To separate the upper pallet, the fork lift operator inserts the tips of the tines into the notches of the lower deck member, raises the upper deck member slightly, and fully inserts the tines into the gap created between the deck members. The asymmetry of the notch pairs in adjacent deck members creates a visual demarcation and guide for easier insertion of the tines by the fork lift operator.

DETAILED DESCRIPTION OF THE INVENTION

Figure 1:
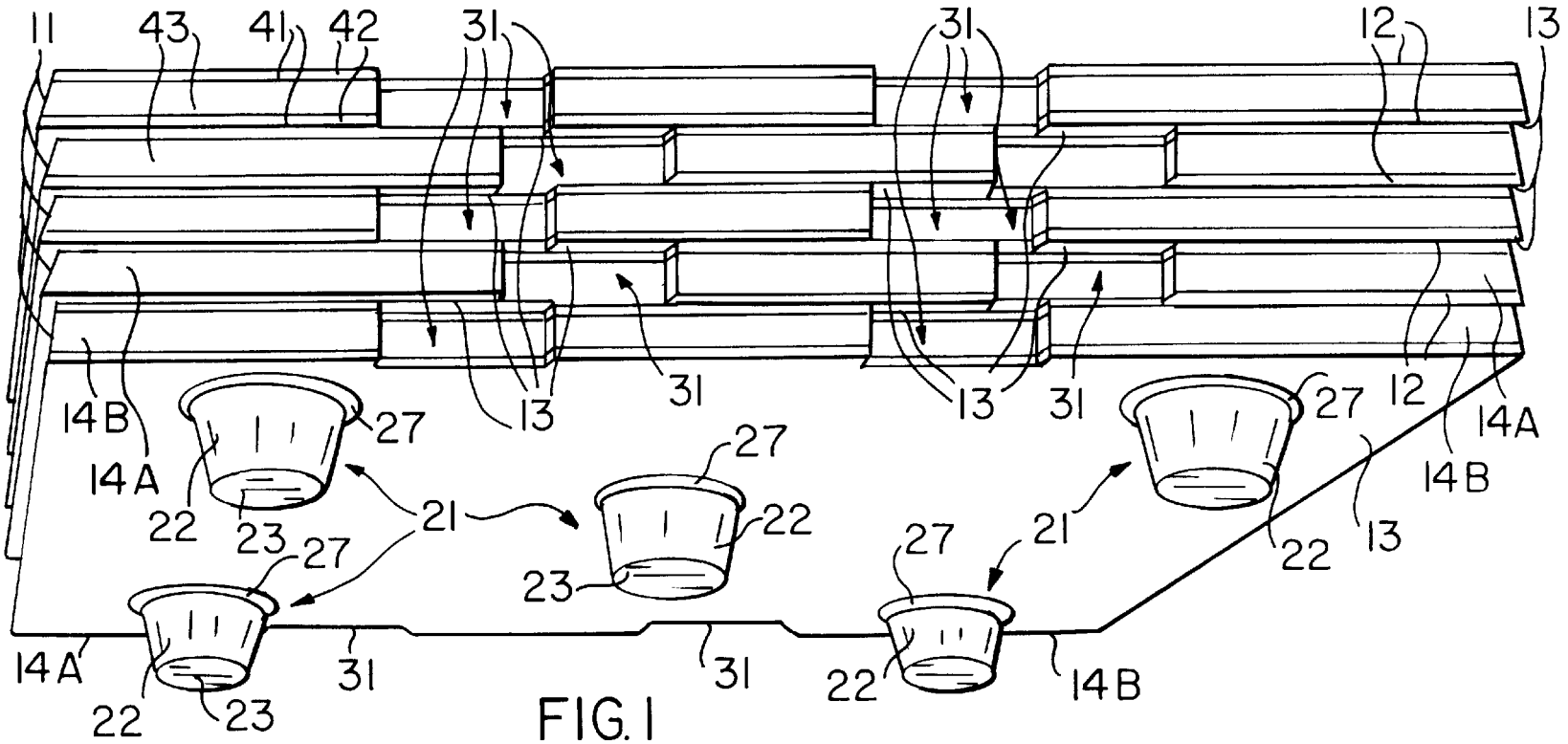
FIG. 1 is a perspective view of a nested stack of pallets.

With reference to the drawings, the invention will now be described in detail with regard for the best mode and the preferred embodiment. In general, the invention comprises a nestable pallet 10 having a single deck member 11 and plural, depending leg members 21 which support the deck member 11 a distance above the ground, floor or other support surface. The deck member 11 is a generally planar, horizontal surface capable of bearing other objects, and such constructions are well known in the industry. The improvement in this construction resides in the provision of plural notches or cut-out portions 31 in at least one, and preferably at least two opposing, edges 14 of the deck member 11, where the notches are asymmetrically positioned relative to the midpoint of the edge 14.

Figure 2:
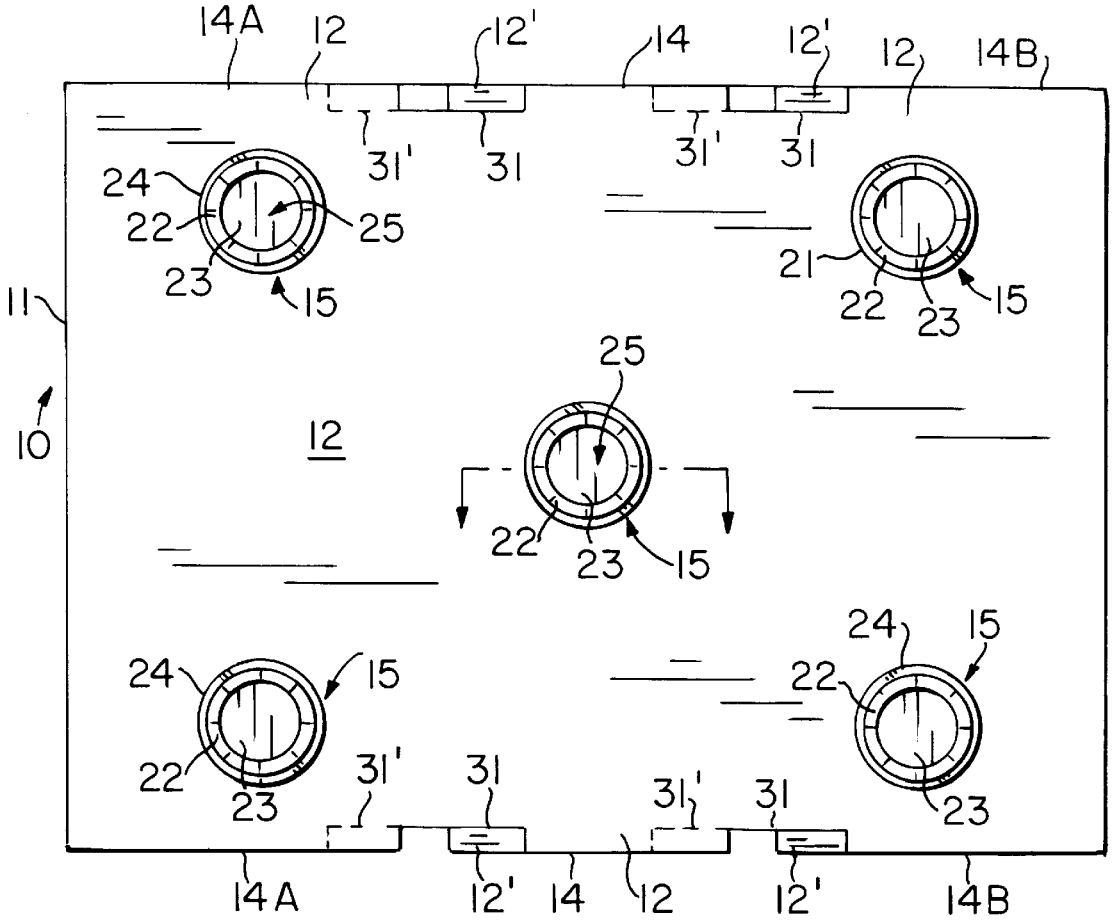
FIG. 2 is a top view of a nested stack of pallets.

As shown in FIGS. 1 and 2, which show a plurality of pallets 10 nested in vertical manner to create a stack, the pallet 10 comprises a deck member 11 with depending leg members 21 attached thereto. The deck member 11 is a generally planar, generally horizontal surface formed of a material of sufficient strength and durability to support a relatively heavy load without excessive bending, such as wood, plywood, plastic or composite materials. The invention is particularly suited for deck members 11 constructed of composite materials, such as a deck member 11 formed with relatively lightweight filler material 43, such as a rigid foam or corrugated cardboard, sandwiched between a relatively thin upper sheet member 41 and a relatively thin lower sheet member 42 composed of plywood. The deck member 11 has a top or upper surface 12 which receives the goods, an underside or lower surface 13, and a peripheral side or edge 14.

Figure 3:
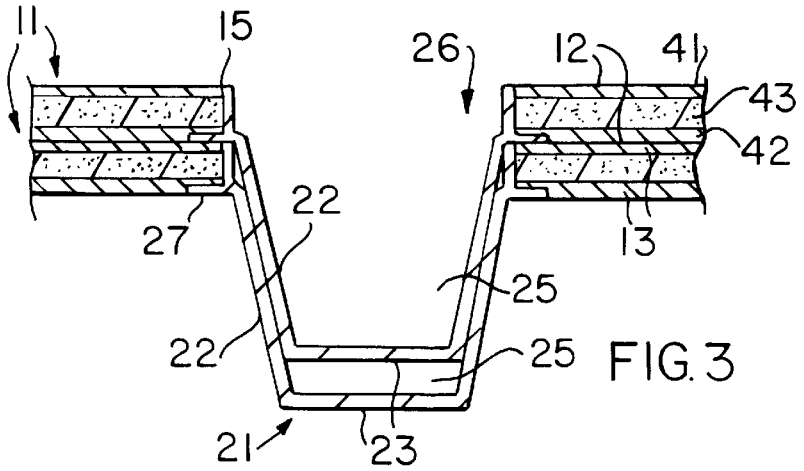
FIG. 3 is a partial cross-sectional view of two leg members of two nested pallets, taken along line III—III of FIG. 2.

The leg members 21 are attached to the deck member 11 so as to extend beneath the deck member 11 when in use, and may be composed of any material having suitable strength and durability properties, such as metal or plastic. The leg members 21 may be attached to the deck member 11 in many suitable ways known in the art. As shown in the drawings, the leg members 21 comprise a tapering side wall 22, a flat bottom 23, a radially extending flange member 27 and an insertion member 24, which in combination define an open top 26 and an open interior 25. The leg members 21 are joined to the deck member 11 with the insertion member 24 extending through a leg aperture 15 in deck member 11, the leg aperture being sized to matingly receive the insertion member portion 24 of the leg member 21, and with the flange 27 abutting or recessed into the lower surface 13 of the deck member 11. The side wall 22 of the leg member 21 tapers in decreasing cross-section in the downward direction, such that the outer diameter or width of the bottom 23 is smaller than the inner diameter or width of the open top 26, thus allowing a leg member 21 to be inserted into the open interior 25 of another leg member 21, as shown in FIG. 3, such that the lower surface 13 of the deck member 11 of a superior or upper nested pallet 10 will directly contact or rest so close to the upper surface 12 of the deck member 11 of the lower or inferior pallet 10 as to preclude insertion of forklift tines between the two deck members 11. The leg members 21 are positioned on the deck member 11 in a manner to allow sufficient space between leg members 21 for insertion of forklift tines from the side of the pallet 10.

In order to allow separation of nested pallets 10 by the forklift operator using only the tines of the forklift without recourse to first manually separating one or more of the upper pallets 10, a pair of cut-outs portions or notches 31 is positioned in one edge 14 of the deck member 11, and preferably a pair of notches 31 are positioned in each of at least two opposing edges 14. Each of the notches 31 has generally vertical walls is dimensioned to be at least as wide as the average four inch width of forklift tines, and are preferably about six inches in width to provide a lateral margin for operator error. The notches 31 extend a short distance, preferably only several inches, into the interior of the deck member 11 so as to minimize reduction in deck surface area, and extend completely through the deck member 11 in the vertical direction such that the notch 31 is present in both the upper surface 12 and the lower surface 13.

The pair of notches 31 on a particular edge 14 of the deck member 11 are asymmetrically located relative to the midpoint or ends of the edge 14, in that one notch 31 of a pair will be located closer to the midpoint than the other notch 31. With the notches 31 offset relative to the center, a short-side edge **14*a* and a long-side edge 14*b* of different lengths are created on each edge 14, the short-side edge 14*a* being shorter in length than the long-side edge 14*b*. The short-side edge 14*a* extends from one corner of the deck member to the outer side of the closest notch 31, and the long-side edge 14*b* extends from the opposite corner to the outer side of the other notch 31. Where as preferred there are notch pairs 31 on opposing edges 14 of the deck member 11, the notch pairs 31** are arranged such that the short-side edges

14*a* are on the same side of the edge midpoints and the long-side edges 14*b* are on the same side of the edge midpoints, as seen in FIG. 2. The off-center distance of the notch pairs 31 and the length of the individual notches 31 are factors of the pallet dimensions 10, especially when the deck member 11 has one or more legs 15 located in the center of the deck member 11 which would be surrounded by the fork lift tines after insertion, since the notches 31 must be located so that the tines can be inserted without striking one of the legs 15. For example for a deck member 11 having edges 14 forty-eight inches long and having a five inch diameter central leg 15 with a twenty-eight inch separation between it and the outer legs 15 for insertion of the tines, an optimum construction would provide notches 31 six inches in length separated by approximately nine inches, with one notch 31 approximately three inches from the edge midpoint, creating a long-side edge 14*b* about fifteen inches long, and with the other notch 31 approximately six inches from the edge midpoint, creating a short-side edge 14*a* about twelve inches long. Both notches 31 are thus positioned within the gap between the center leg 15 and the outer legs 15.

By asymmetrically mounting the notches 31 in a given edge 14, pallets 10 can be vertically nested with alternating sets of pallets rotated 180 degrees, such that one set of pallets 10 will have the short-side edges 14*a* positioned to the left, while the other set of pallets will have the short-side edges 14*a* positioned to the right. Thus the notches 31 of adjacent pallets 10 will not align in a straight vertical column, but instead any given notch 31 will be offset from each notch 31 either above or below it. As shown in the vertical perspective of FIG. 2, a portion of the upper surface 12' of a lower or inferior pallet 10 will be exposed through the notches 31 of an upper or superior nested pallet 10 because the notches 31' of the inferior pallet 10 are offset from the notches 31 of the superior pallet 10. Referring to the lower perspective view of FIG. 1, it is seen that the alternating notch pairs 31 provide a well-defined visual demarcation between adjacent deck members 11. In any pair of adjacent pallets 10, a portion of the lower surface 13 of each superior deck member 11 is exposed above the notches 31 of the inferior deck member 11. For the dimensions set forth above, about three inches of the lower surface 13 of the superior deck member 11 will be exposed above the six inch notch 31 in the inferior deck member 11.

This construction allows a forklift operator to insert the tips of the tines into the notches 31 of the inferior pallet 10 so that the tips are beneath the exposed portion of the lower surface 13 of the superior deck member 11. The operator then lifts the superior pallet 10 slightly to provide a vertical gap between the two adjacent deck members 11, and then inserts the tines fully between the two deck members 11. The operator can then lift the superior pallet 10 completely from the inferior pallet 10.

It is understood that equivalents and substitutions for certain elements set forth above may be obvious to those skilled in the art, and the true scope and definition of the invention therefore is to be as set forth in the following claims.

I claim:

1. In a vertical stack of at least two nested, single deck member pallets defining at least one superior pallet nested above an adjacent inferior pallet, each said pallet having only one generally planar, horizontally disposed deck member having an upper surface, a lower surface, a midpoint, corners and edges, leg apertures extending through said deck member interior to said edges, and a plural number of depending leg members mounted within said leg apertures to support the deck member above a surface, the leg members having an open top, an open interior and tapering side walls such that the leg members of a superior pallet are received by the leg members of an inferior pallet when vertically stacked in an unloaded condition with the lower surface of any said superior pallet immediately above the upper surface of the adjacent said inferior pallet, the improvement comprising:

a pair of notches distinct from said leg apertures, each notch at least approximately four inches wide, positioned on one of said edges of said deck member of each of said pallets, said notches extending vertically completely through said upper and said lower surfaces of said deck member, whereby said notches of any two adjacent pallets are offset.

2. The pallet stack of claim 1, where said notches are asymmetrically positioned on each of said one of said edges so as to define a short-side edge between one said corner and one said notch and a long-side edge between another said corner and the other said notch, said short-side edge being shorter than said long-side edge, with the edge midpoint located between said pair of notches.

3. The pallet stack of claim 2, further comprising at least one more pair of notches positioned on another of said edges of each said deck member, said notches extending vertically completely through said upper and said lower surfaces of said deck member, where said notches are asymmetrically positioned on said another edge so as to define a short-side edge between one said corner and one said notch and a long-side edge between another said corner and the other said notch, said short-side edge being shorter than said long-side edge, with the edge midpoint located between said pair of notches.

4. The pallet stack of claim 3, where said one edge and said another edge are two opposing edges of each said deck member.

5. The pallet stack of claim 4, where said short-side edges of said two opposing edges are on the same side of the edge midpoints and said long-side edges of said two opposing edges are on the same side of the edge midpoints.

6. A pair of vertically nested, single deck member pallets, each said pallet having only one generally planar, horizontally disposed deck member having an upper surface, a lower surface, midpoint, corners and edges, leg apertures extending through said deck member interior to said edges, and a plural number of depending leg members mounted within said leg apertures to support the deck member above a surface, the leg members having an open top, an open interior and tapering side walls such that the leg members of the superior of said pallets are received by the leg members of the inferior of said pallets when vertically stacked in an unloaded condition such that the lower surface of the deck member of the superior patent abuts or rests close to the upper surface of the deck member of the inferior patent, each of said pallets further comprising a pair of notches distinct from said leg apertures, each notch at least approximately four inches wide, positioned on one of said edges of said deck member of each of said pallets, said notches extending vertically completely through said upper and said lower surfaces of said deck member, whereby said notches of said pallets are offset when vertically stacked in an unloaded condition.

7. The pallet of claim 6, where said notches are asymmetrically positioned on each of said one of said edges so as to define a short-side edge between one said corner and one said notch and a long-side edge between another said corner and the other said notch, said short-side edge being shorter than said long-side edge, with the edge midpoint located between said pair of notches.

8. The pallet pair of claim 7, further comprising at least one more pair of notches positioned on another of said edges of each said deck member, said notches extending vertically completely through said upper and said lower surfaces of said deck member, where said notches are asymmetrically positioned on said another edge so as to define a short-side edge between one said corner and one said notch and a long-side edge between another said corner and the other said notch, said short-side edge being shorter than said long-side edge, with the edge midpoint located between said pair of notches.

9. The pallet pair of claim 8, where said one edge and said another edge are two opposing edges of each said deck member.

10. The pallet pair of claim 9, where said short-side edges of said two opposing edges are on the same side of the edge midpoints and said long-side edges of said two opposing edges are on the same side of the edge midpoints.

11. A pair of nestable, single deck member pallets, each having only one generally planar, horizontally disposed deck member having an upper surface, a lower surface, midpoint, corners and edges, and a plural number of depending leg members to support the deck member above a surface, where the deck member is apertured at the leg locations and the leg members have an open top, an open interior and tapering side walls such that the leg members of one of said pallets are received by the leg members of the other of said pallets when said pallets are vertically stacked in an unloaded condition such that the lower surface of the deck member of the superior patent abuts or rests close to the upper surface of the deck member of the inferior patent, each of said pallets further comprising a pair of notches, each notch at least approximately four inches wide, positioned on one of said edges of said deck member, said notches extending vertically completely through said upper and said lower surfaces of said deck member, where said notches are asymmetrically positioned on said edge so as to define a short-side edge between one said corner and one said notch and a long-side edge between another said corner and the other said notch, said short-side edge being shorter than said long-side edge, with the edge midpoint located between said pair of notches, whereby said pallets can be oriented when stacked such that the pair of notches on one of said pallets are not vertically aligned with the pair of notches of the other of said pallets.

12. The pallet pair of claim 11, each of said pallets further comprising at least one more pair of notches positioned on another of said edges of said deck member, said notches extending vertically completely through said upper and said lower surfaces of said deck member, where said notches are asymmetrically positioned on said another edge so as to define a short-side edge between one said corner and one said notch and a long-side edge between another said corner and the other said notch, said short-side edge being shorter than said long-side edge, with the edge midpoint located between said pair of notches.

13. The pallet pair of claim 12, where said one edge and said another edge are two opposing edges of said deck member.

14. The pallet pair of claim 13, where said short-side edges of said two opposing edges are on the same side of the edge midpoints and said long-side edges of said two opposing edges are on the same side of the edge midpoints.

* * * * *